US009169040B2

(12) United States Patent
Evans et al.

(10) Patent No.: US 9,169,040 B2
(45) Date of Patent: Oct. 27, 2015

(54) NESTABLE PALLET AND STACKABLE SLEEVE PACK

(71) Applicants: Dale Evans, Windsor, WI (US); Andrew Prell, DeForest, WI (US)

(72) Inventors: Dale Evans, Windsor, WI (US); Andrew Prell, DeForest, WI (US)

(73) Assignee: Dale Evans Inc., DeForest, WI (US)

( * ) Notice: Subject to any disclaimer, the term of this patent is extended or adjusted under 35 U.S.C. 154(b) by 0 days.

(21) Appl. No.: 14/059,140

(22) Filed: Oct. 21, 2013

(65) Prior Publication Data

US 2015/0108037 A1 Apr. 23, 2015

(51) Int. Cl.
*B65D 19/38* (2006.01)
*B65D 19/18* (2006.01)

(52) U.S. Cl.
CPC ..... *B65D 19/18* (2013.01); *B65D 2203/02* (2013.01); *B65D 2303/00* (2013.01); *B65D 2519/00034* (2013.01); *B65D 2519/00069* (2013.01); *B65D 2519/00129* (2013.01); *B65D 2519/00134* (2013.01); *B65D 2519/00139* (2013.01); *B65D 2519/00174* (2013.01); *B65D 2519/00208* (2013.01); *B65D 2519/00268* (2013.01); *B65D 2519/00273* (2013.01); *B65D 2519/00288* (2013.01); *B65D 2519/00293* (2013.01); *B65D 2519/00318* (2013.01); *B65D 2519/00338* (2013.01); *B65D 2519/00437* (2013.01); *B65D 2519/00457* (2013.01); *B65D 2519/00497* (2013.01); *B65D 2519/00562* (2013.01); *B65D 2519/00572* (2013.01); *B65D 2519/00641* (2013.01); *B65D 2519/00661* (2013.01); *B65D 2519/00711* (2013.01); *B65D 2519/00945* (2013.01); *B65D 2519/00975* (2013.01)

(58) Field of Classification Search
CPC ..... B65D 2519/00338; B65D 2519/00328; B65D 2519/00288; B65D 2519/0094; B65D 2519/00955; B65D 2519/00935
USPC ..... 108/53.3, 53.1, 53.5, 57.25, 51.11, 901, 108/902, 147.13
See application file for complete search history.

(56) References Cited

U.S. PATENT DOCUMENTS

| | | | | | |
|---|---|---|---|---|---|
| 2,973,931 | A | * | 3/1961 | Brown | 108/53.3 |
| 3,140,672 | A | * | 7/1964 | De Luca | 108/53.3 |
| 3,526,195 | A | * | 9/1970 | Maryonovich | 108/53.1 |
| 3,696,761 | A | * | 10/1972 | Brown | 108/53.3 |
| 4,000,704 | A | * | 1/1977 | Griffin, Jr. | 108/53.1 |
| RE32,344 | E | * | 2/1987 | Wind | 108/53.1 |
| 4,838,176 | A | * | 6/1989 | Bowser et al. | 108/53.3 |
| 5,094,175 | A | * | 3/1992 | Christie | 108/901 |
| 5,109,985 | A | * | 5/1992 | Rose | 108/55.1 |
| 5,279,231 | A | * | 1/1994 | Kolvites et al. | 108/107 |
| 5,341,748 | A | * | 8/1994 | Liu | 108/53.3 |
| 5,415,286 | A | * | 5/1995 | Marchek et al. | 206/599 |
| 5,582,113 | A | * | 12/1996 | Langenbeck | 108/57.26 |
| 5,651,463 | A | * | 7/1997 | Major et al. | 108/53.3 |
| D400,681 | S | * | 11/1998 | Sadr | D34/38 |
| 5,830,299 | A | * | 11/1998 | Teixidor Casanovas et al. | 108/53.3 |
| 7,360,493 | B2 | * | 4/2008 | Hummel et al. | 108/53.3 |
| 7,819,068 | B2 | * | 10/2010 | Apps et al. | 108/53.3 |
| 2012/0048154 | A1 | * | 3/2012 | Toomer et al. | 108/53.3 |

* cited by examiner

*Primary Examiner* — Jose V Chen
(74) *Attorney, Agent, or Firm* — Quarles & Brady LLP

(57) ABSTRACT

A nestable pallet includes a first frame, at least one corner foot extending away from the frame, and at least one off-set corner foot extending away from the frame. The at least one corner foot being complementary with the at least one off-set corner foot, such that the pallet is nestable with a substantially identical pallet in a first nesting configuration and a second nesting configuration. In a preferred embodiment, the first frame includes a structural sheet fixed to the frame.

19 Claims, 5 Drawing Sheets

NESTABLE PALLET AND STACKABLE SLEEVE PACK

CROSS REFERENCES TO RELATED APPLICATIONS

Not Applicable

STATEMENT REGARDING FEDERALLY SPONSORED RESEARCH

Not Applicable.

BACKGROUND OF INVENTION

Sleeve pack containers used for the storage and movement of bulk materials or other items are known in the art. Once filled with bulk materials or other items, the sleeve packs are placed onto conveyances, transported to a given destination and then removed from the conveyance to be unloaded. In general, known sleeve pack containers are collapsible and include two specialized pallets enclosing a reusable sleeve. Conventional sleeve packs are typically made up of a standard pallet size plastic base for forklift entry, foldable, collapsible walls, and a plastic lid. When empty, the sleeve packs can be collapsed down and the base and lid nested together for shipping and to conserve warehouse space. However, often times, the base and lid assemblies are different in design and structure which leads to increased manufacturing costs.

Some known sleeve packs have bases nestable with lids, such that the stacking height of sleeve packs is reduced. These stacked sleeve packs must be properly oriented for a base of one sleeve pack to nest with a lid of another sleeve pack. Properly orientating a sleeve pack for stacking can require rotating the entire sleeve pack 180 degrees from an unnestable orientation to a nestable orientation. Taking the time to properly orient sleeve packs for compact stacking decreases efficiency.

Sleeve packs must be able to support and contain heavy loads. As a result, known molded sleeve pack bases and lids are typically formed from a material having sufficient thickness to provide strength and rigidity necessary for a fully loaded sleeve pack. Material thickness has a direct impact on material costs.

Therefore, a need exists for a stackable sleeve pack system that reduces the above identified inefficiencies and costs of current sleeve pack containers.

SUMMARY OF THE INVENTION

In one embodiment of the invention, a nestable pallet is suitable for use as both a sleeve pack base and lid, and does not require rotating the base or lid 180 degrees from an unnestable orientation to a nestable orientation. The nestable pallet includes a first frame, at least one corner foot extending away from the frame, and at least one off-set corner foot extending away from the frame. The at least one corner foot being complementary with the at least one off-set corner foot, such that the pallet is nestable with a substantially identical pallet in a first nesting configuration and a second nesting configuration. In the first nesting configuration, the at least one corner foot of the nestable pallet is inserted into a corner foot of the substantially identical pallet. In the second nesting configuration the nestable pallet is oriented relative to a substantially identical pallet less than 180 degrees from an unnestable orientation to a nestable orientation. In the unnestable orientation, the at least one corner foot of the nestable pallet is aligned with at least one corner foot of the substantially identical pallet and the at least one off-set corner foot of the nestable pallet is aligned with at least one off-set corner foot of the substantially identical pallet. In the nestable orientation, the at least one corner foot of the substantially identical pallet is aligned with a receiving area adjacent the at least one off-set corner foot of the nestable pallet and the at least one off-set corner foot of the substantially identical pallet is aligned with a receiving area adjacent said at least corner foot of the nestable pallet.

In another embodiment of the invention, a nestable pallet is formed from a thin material reducing material costs. The nestable pallet includes a first frame molded to have a material thickness of less than about 0.200 inches. A support surface including a structural sheet bonded to the frame increases the rigidity and strength of the nestable pallet.

The foregoing and other objects and advantages of the invention will appear from the following detailed description. In the description, reference is made to the accompanying drawings which illustrate a preferred embodiment of the invention.

DETAILED DESCRIPTION OF THE INVENTION

The present invention provides a stackable sleeve pack system for the storage and movement of bulk materials or other items. The stackable sleeve pack system provides a nestable pallet base and lid that are the same in design and structure, in comparison to a different base and lid design and structure afforded by conventional sleeve pack containers. Accordingly, manufacturing costs of the stackable sleeve pack system of the present invention are lower in comparison to conventional sleeve pack containers. Additionally, the legs of the pallet base and lid of the present invention are structured so that when nested together, binding and/or sticking of the pallet base and lid is inhibited.

Figure 1:
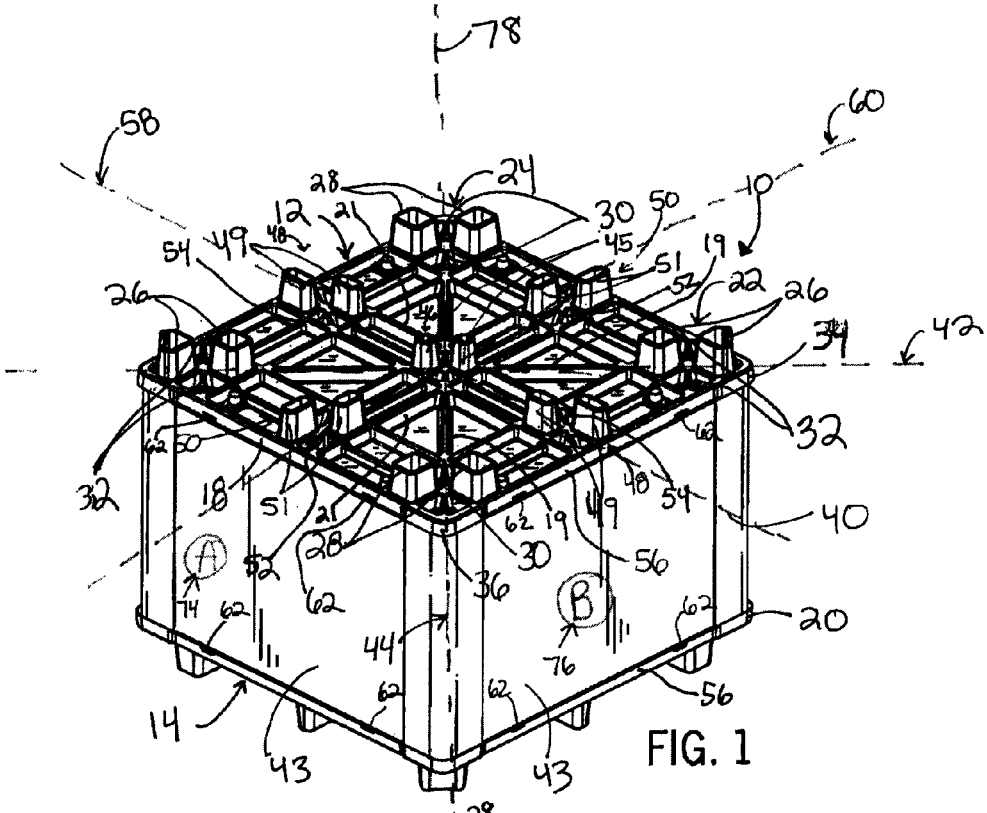
FIG. 1 is a top perspective view of a stackable sleeve pack according to one embodiment of the invention.
Figure 2:
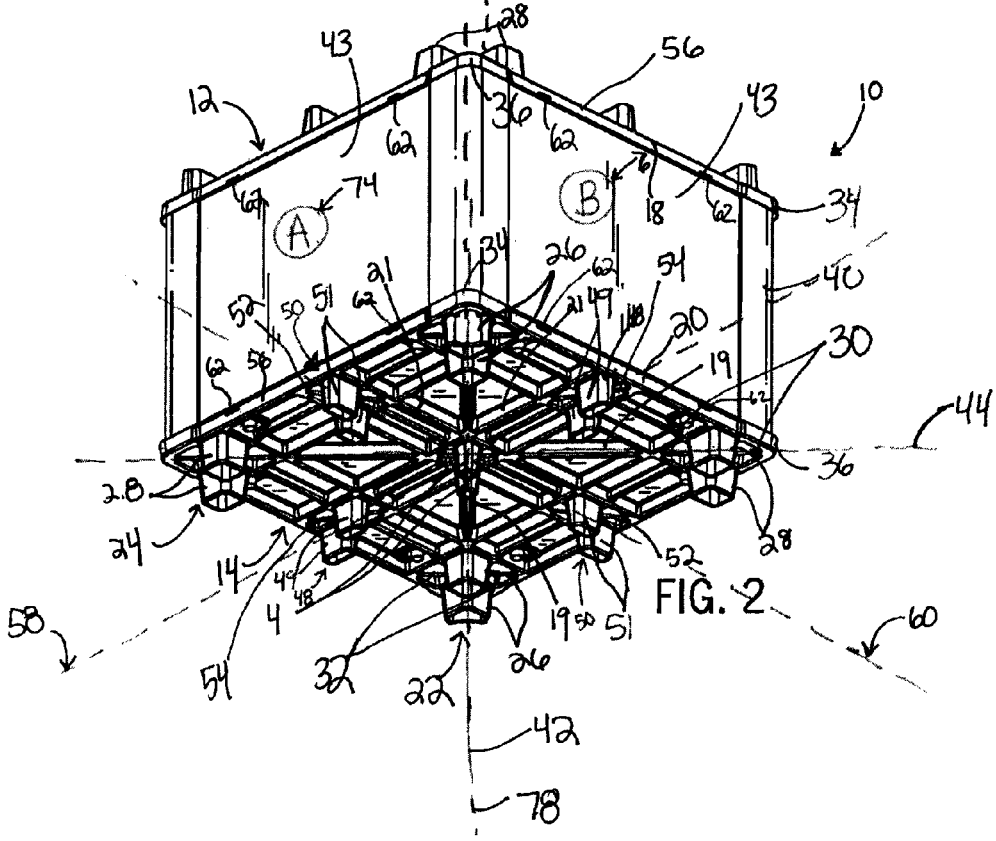
FIG. 2 is a bottom perspective view of the stackable sleeve pack of FIG. 1.
Figure 3:
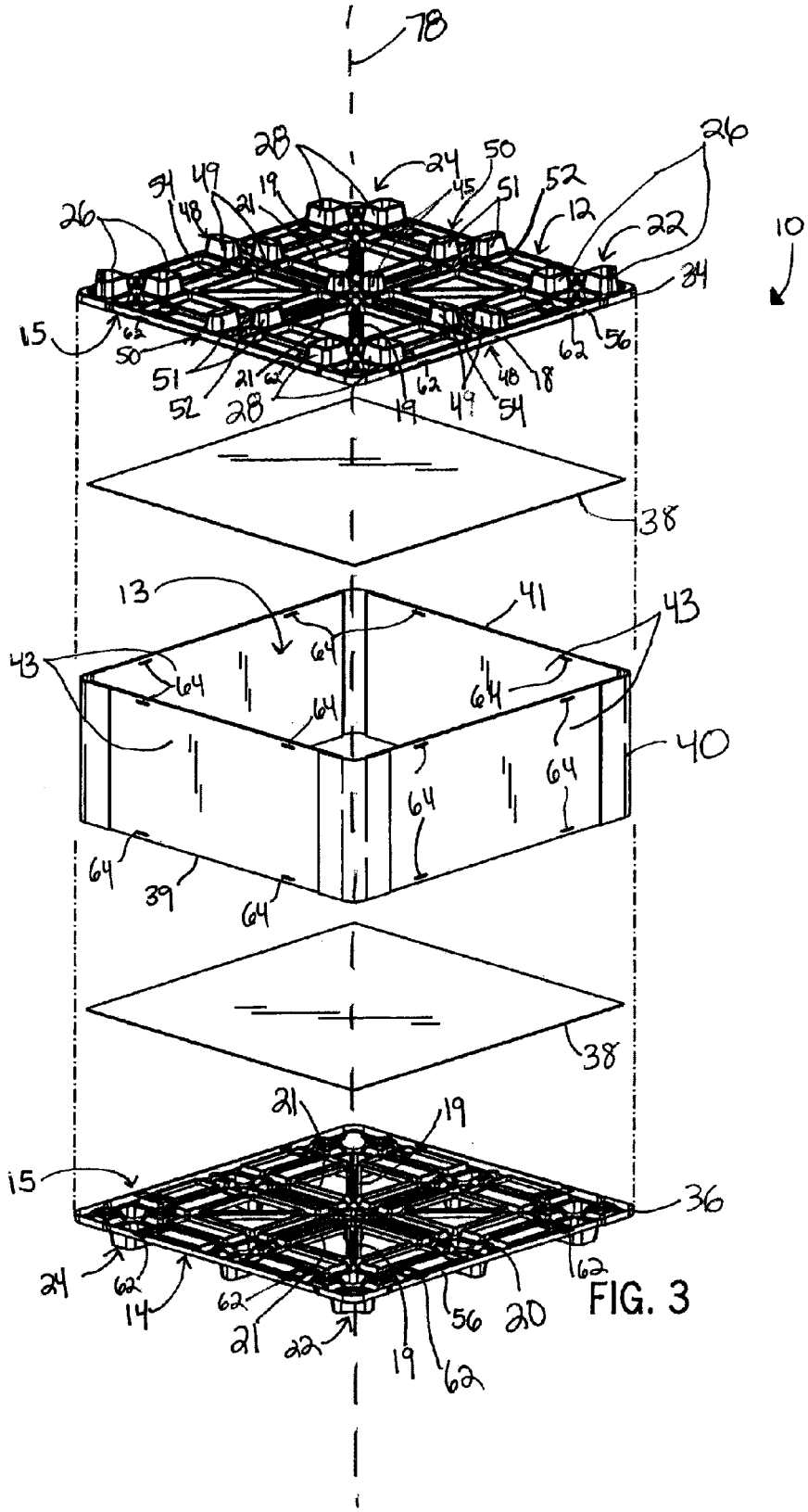
FIG. 3 is an exploded view of the stackable sleeve pack of FIG. 1.

FIGS. 1 and 2 illustrate a stackable sleeve pack system 10, according to the present invention, including a sleeve 40 supported by a first nestable pallet 14. The sleeve 40 includes side walls 43, as shown in FIG. 3, formed of corrugated plastic, for example, or any other suitable material. A second nestable pallet 12, substantially identical to the first nestable pallet 14, is supported by the sleeve 40. The first and second nestable pallets 14, 12 define a hollow container space 13 therebetween surrounded by the side walls 43 of the sleeve 40. The container space 13 can be filled with bulk materials or other items that can be conveyed using a fork truck, for example, or any other material handling vehicle.

The first nestable pallet 14 includes a first frame 20 that is generally square shaped having four corners 34, 36 and constructed of a thermoplastic, such as high-density polyethylene (HDPE), polypropylene, or any other suitable moldable polymeric material. Preferably, the first frame is injection molded HDPE having a material thickness between 0.200 and 0.090 inches to provide a light-weight flexible frame with minimal material. Although injection molding is preferred, the first nestable pallet 14 can be manufactured using other processes, such as twin-sheet thermoforming process, blow-molding process, rotational molding process, or any other suitable molding process that can form a thin material frame without departing from the scope of the invention.

Figure 6:
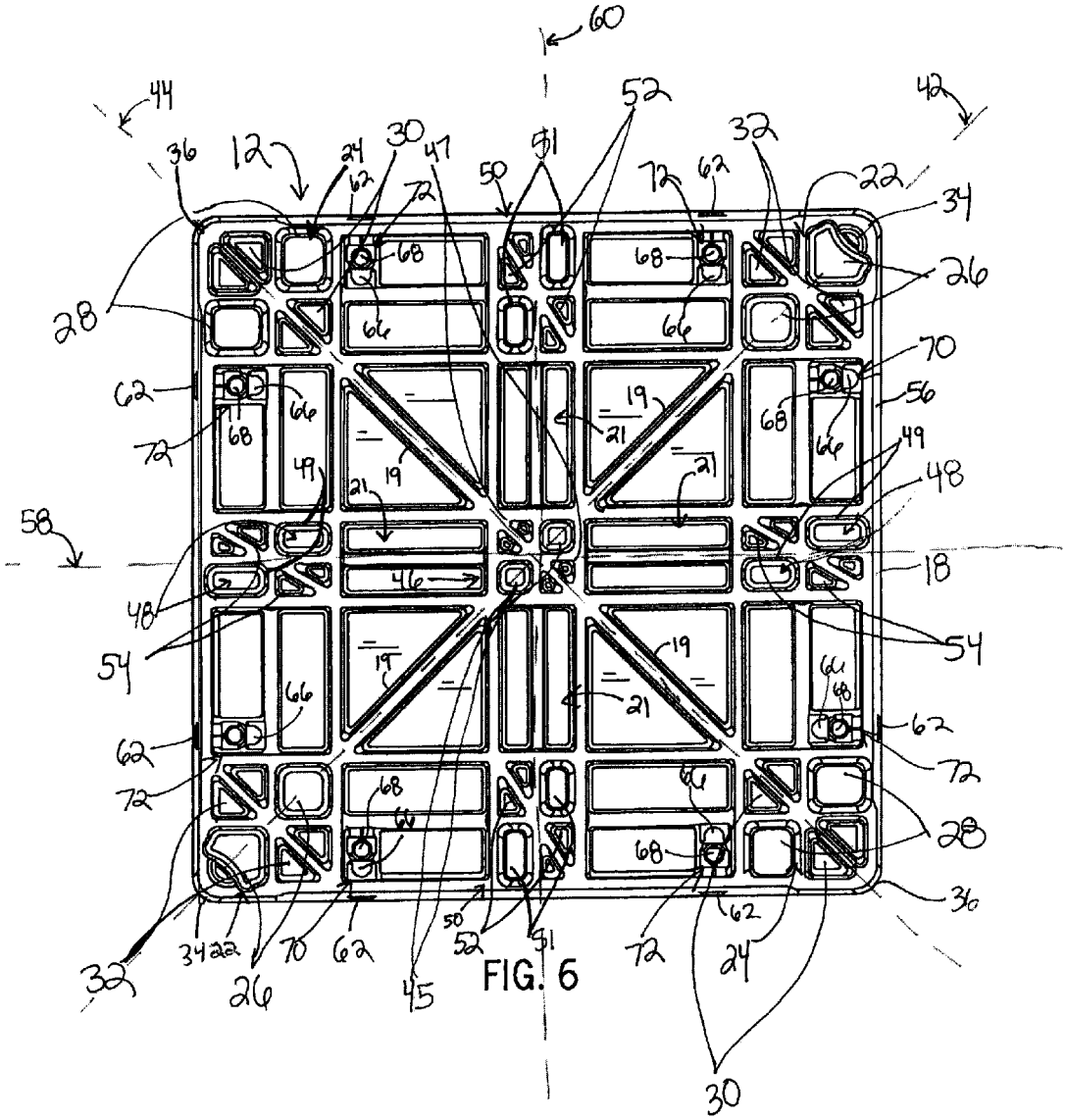
FIG. 6 is bottom perspective view of a nestable pallet of the stackable sleeve pack of FIG. 1.

Referring now to FIG. 6, each diagonally opposite corner 34 includes a corner foot 22, and each diagonally opposite corner 36 includes an off-set corner foot 24. Angled ribs 19 adding rigidity and load capacity to the pallet 14 extend between each corner foot 22 along a line 42 and between each off-set corner foot 24 along a line 44. Further, the first nestable pallet 14 includes cross-support structures 21 for additional rigidity and strength. The cross-support structures 21 extend between a first side foot 48 and a second side foot 50, as will be discussed below.

Figure 7:
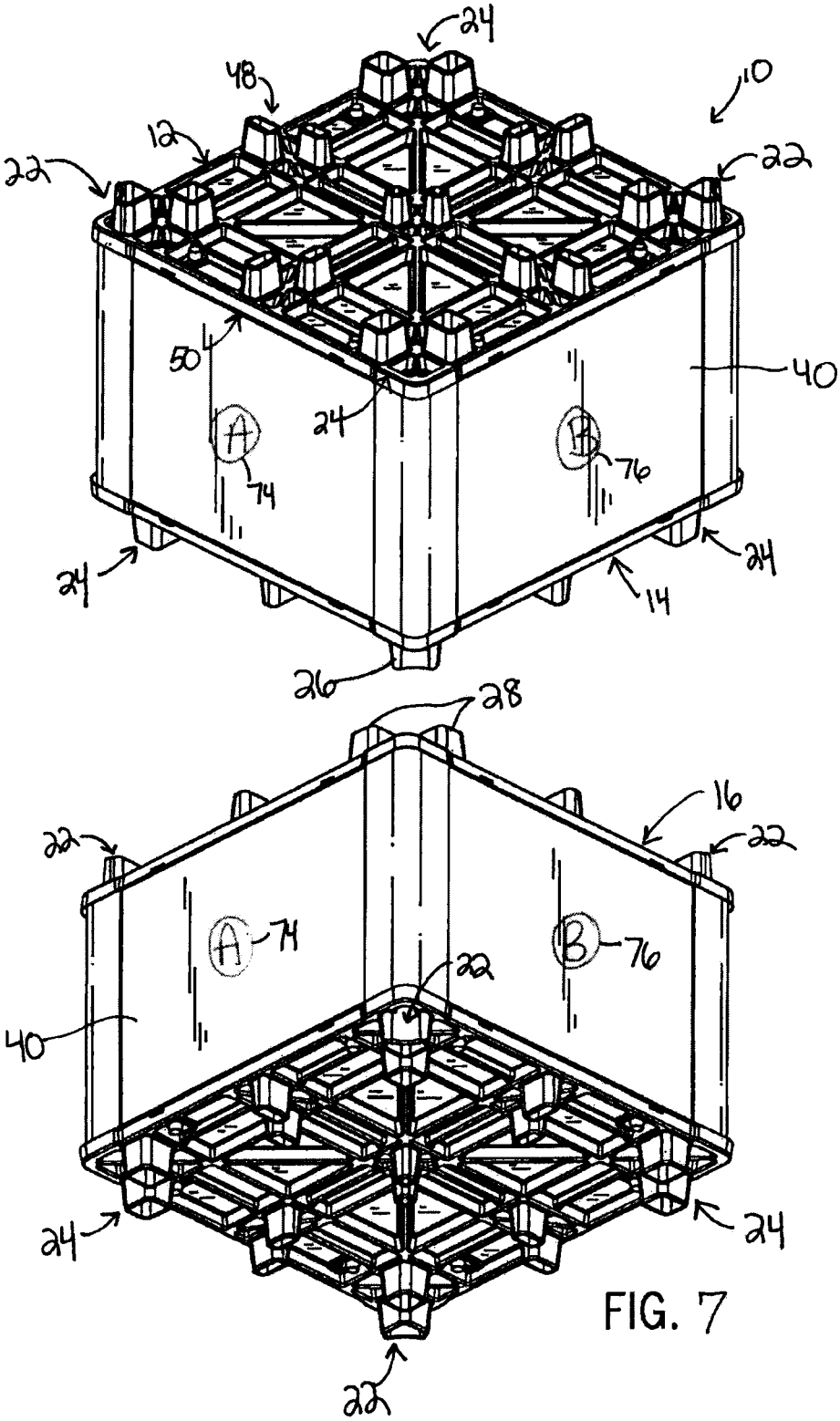
FIG. 7 is a perspective view the stackable sleeve pack of FIG. 1 properly stacked with another stackable sleeve pack.

With further reference to the first nestable pallet 14, both the corner foot 22 and the off-set corner foot 24 are coupled to the first frame 20 and provide contact points to either the ground or a third nestable pallet 16, as shown in FIG. 7. The corner foot 22 extends away from the first frame 20 and is proximal a first corner 34, as shown in FIG. 2, to facilitate stacking the stackable sleeve pack 10. Similarly, the off-set corner foot 24 extends away from the first frame 20 in the same direction as the corner foot 22, and is proximal a second corner 36. A corner foot 22 and off-set corner foot 24 are also present at a position opposite the first corner 34 and the second corner 36, respectively. The positioning of the corner and off-set corner feet 22, 24 can also help guide a set of forks of a fork truck to convey the stackable sleeve pack 10 from one location to another.

As best shown in FIG. 6, the corner foot 22 is composed of two legs 26 aligned with the first line 42 that extends through the center of the first frame 20. The two legs 26 can be the shape of a square, pentagon, or any other suitable geometric shape, and do not have to be the same shape, as shown in FIG. 6. Similarly, the off-set corner foot 24 is composed of two legs 28 that are oppositely offset from the second line 44, which is perpendicular to the first line 42, extending through the center of the first frame 20. The two legs 28 can also be the shape of a square, pentagon, or any other suitable geometric shape. Adjacent the two legs 28 that constitute the off-set corner foot 24 is a receiving area 30 for receiving two legs 26 of a corner foot 22 of forming part of a substantially identical nestable pallet of another stackable sleeve pack 10. The receiving area 30 is aligned parallel with the first line 42 that extends through the center of the first frame 20 and is partially exposed on the sides not adjacent to the two legs 28. Similarly, adjacent the two legs 26 that constitute the corner foot 22 is a receiving area 32 for receiving two legs 28 of an off-set corner foot 24 of the substantially identical nestable pallet of the another stackable sleeve pack 10. The receiving area 32 straddles the second line 44 and is partially exposed on the sides not adjacent to the two legs 26. Due to the receiving areas 30, 32 being partially exposed, the nestable pallets 12, 14 are inhibited from sticking and/or binding together when stacked.

In addition to the corner foot 22 and the off-set corner foot 24, the first frame 20 also includes a central foot 46 proximal the intersection of the first line 42 and second line 44, as shown in FIGS. 1 and 2. The central foot 46 includes two legs 45 configured to be nested with the central foot 46 of another stackable sleeve pack 10. The two legs 45 that compose the central foot 46 are generally square in shape, and are aligned with the first line 42 and positioned where the first line 42 and the second line 44 intersect. Of course, the two legs 45 of the central foot 46 can be a different geometric shape and aligned with the second line 44 without departing from the scope of the invention. The central foot 46 is adjacent to a central receiving area 47, as best shown in FIG. 6, for receiving the two legs 45 of the central foot 46 of the substantially identical nestable pallet of the another stackable sleeve pack 10.

The first frame 20 also includes first side feet 48 proximal opposing sides of an outer perimeter 56 of the first frame 20 and between an adjacent corner foot 22 and off-set corner foot 24, as shown in FIG. 6. Each first side foot 48 includes two legs 49 that are generally rectangular in shape and extend away from the first frame 20 in the same direction as the corner feet 22. However, the two legs 49 may be a square, a pentagon, or any other suitable geometric shape, and do not have to be the same shape, as shown in FIG. 6. The two legs 49 of the first side foot 48 are oppositely offset from a line 58 and spaced from the outer perimeter 56 of the first frame 20 different distances to form a receiving area 54. The two legs 49 are oppositely offset from the line 58 in a similar manner to the way the two legs 45 of the central foot 46 are oppositely offset from line 58. Of course, the two legs 49 of the first side foot 48 can be oppositely offset from the line 58, thereby taking the place of a receiving area 54 without departing from the scope of the invention. The receiving area 54 is adjacent the two legs 49 of the first side foot 48 and is configured to receive a second side foot 50 of the substantially identical nestable pallet of the another stackable sleeve pack 10.

Similar to the first side foot 48, the second side foot 50 includes two legs 51 that are generally rectangular in shape. However, the two legs 51 may be a square, a pentagon, or any other suitable geometric shape, and do not have to be the same shape, as shown in FIG. 6. The two legs 51 of the second side foot 50 are oppositely offset from a line 60 and positioned on the outer perimeter 56 of the first frame 20. The two legs 51 are oppositely offset from the line 60 in a similar manner to the way the two legs 45 of the central foot 46 are oppositely offset from line 60. Of course, the two legs 51 of the second side foot 50 can be oppositely offset from the line 60, thereby taking the place of a receiving area 52 without departing from the scope of the invention. The receiving area 52 is adjacent the two legs 51 of the second side foot 50 and is configured to receive the first side foot 48 of the substantially identical nestable pallet of the another stackable sleeve pack 10.

With further reference to the first side foot 48 and the second side foot 50, the receiving areas 52, 54 are advantageously partially exposed. As best shown in FIGS. 1 and 2, the receiving areas 52, 54 are partially exposed on the sides that are not adjacent to the two legs 49, 51 of the first side foot 48 and the second side foot 50, respectively. This partial exposure of the receiving areas 52, 54 further inhibits the nestable pallets 12, 14 from sticking and/or binding together when stacked. Additionally, the positioning of the central foot 46 and the first and second side feet 48, 50 relative to both of the corner foot 22 and the off-set corner foot 24 can help guide a set of forks of a fork truck. For example, the set of forks may be slid along a path that is parallel to either line 58 or line 60, and the set of forks can straddle either line 58 or line 60 to convey the stackable sleeve pack 10 from one location to another.

Advantageously, in a first nesting configuration, the first nestable pallet 14 is nestable with another first nestable pallet 14 by inserting the downwardly extending feet 22, 24, 46, 48, and 50 of the first nestable pallet 14 into the downwardly extending feet 22, 24, 46, 48, and 50 of another first nestable pallet 14. Advantageously, nesting the first nestable pallets 14 with other first nestable pallets 14 in the first configuration provides a compact stack of nestable pallets 14 for shipping. As described in further detail below, the first nestable pallets 14 are also nestable in a second nesting configuration with other first nestable pallets 14 or substantially identical second nestable pallets 12 to securely stack stackable sleeve packs 10 formed from substantially identical nestable pallets 12, 14.

A structural sheet 38 forming a load support surface, shown in FIG. 3, is coupled to an inside surface 15 of the first frame 20 to strengthen the rigidity of the thin, flexible molded first frame. 14. Preferably, the structural sheet 38 is of a rigid, flat or corrugated sheet of plastic that stiffens the first frame 20. The structural sheet, however, can be any structural material, such as wood, metal, and the like without departing from the scope of the invention.

In the embodiment described herein, the structural sheet is positioned inwardly from an upwardly extending outer perimeter lip 56 of the first frame 20, as shown in FIG. 6, and bonded to the first frame 20 using adhesives. Advantageously, the adhesive secures the structural sheet 38 in place in order to provide additional strength and rigidity for the first nestable pallet 14. Although, bonding the structural sheet 38 to the first frame 20 using any suitable type of adhesive, contact adhesive, epoxy resin, or glue is preferred, the structural sheet 38 can be fastened to the first nestable pallet 14 using bolts, rivets, screws, or the like, without departing from the scope of the invention. Of course, if a structural sheet is not provided, the inside surface 15 of the first frame 20 forms a load support surface.

As described above, the sleeve 40 is defined by side walls 43 that are coupled to the first nestable pallet 14 along a perimeter of a lower edge 39 of the sleeve 40 and surround the hollow container space 13, as shown in FIG. 3. The sleeve 40 upwardly extends from the first nestable pallet 14 inside the upwardly extending outer perimeter lip 56 of the first frame 20 and is configured for receiving bulk materials or other items to be stored. The lower edge 39 of the sleeve 40 includes slots 64 that are configured to be received by slidable tabs 62 that are positioned on the outer perimeter 56 of the first frame 20. The tabs 62 extend through the sleeve slots 64 and out of slots formed through the upwardly extending outer perimeter lip 56 of the first frame 20 to fix the sleeve 40 relative to the first frame 20. Alternatively, the sleeve 40 may be joined or locked together by a snap-fit mechanism, using clips, screws, and other fastening methods known in the art without departing from the scope of the invention.

The sleeve 40 supports the second nestable pallet 12 above the hollow container space 13, as shown in FIG. 1. The second nestable pallet 12 is substantially identical to the first nestable pallet 14 and includes a second frame 18 with feet 22, 24, 46, 48, and 50 that extend away from the second frame 18 and with receiving areas 30, 32, 47, 52, 54 to facilitate stacking the stackable sleeve pack 10. The inside surface 15 of the second frame 18 also includes a structural sheet 38 to provide strength and rigidity for the second nestable pallet 14. The structural sheet 38 may be coupled to the inside surface 15 of the second nestable pallet 12 in a similar manner as previously described. Further, the upper edge 41 of the sleeve 40 includes slots 64 that are configured to received the slidable tabs 62 positioned on the outer perimeter 56 of the second frame 18. The tabs 62 and slots 64 may be joined or locked together by a snap-fit mechanism, for example, or in other manners as previously discussed in relation to the first frame 20. Once the tabs 62 and the slots 64 are engaged, the stackable sleeve pack 10 is completely assembled.

Preferably, the second nestable pallet 12 is oriented, as best shown in FIGS. 1 and 2 or FIGS. 4 and 5, such that corner feet 22 of the first nestable pallet 14 are aligned with the receiving areas 30 of the second nestable pallet 12 and the off-set corner feet 24 of the second nestable pallet 14 are aligned with the receiving areas 32 of the first nestable pallet 14. In the embodiment described herein, the second nestable pallet 12 is oriented approximately 90 degrees about the central axis 78 relative to the first nestable pallet 14 on the sleeve 40, Although orienting the second nestable pallet ninety degrees relative to the first nestable pallet of a sleeve pack is preferred to simplify stacking of the sleeve packs, the first and second nestable pallets forming a sleeve pack can have any orientation in which the second pallet is rotated less than 180 degrees from an unnestable position to a nestable position about a central axis 78 perpendicular to a plane defined by the inside surface 15 of first frame 20 relative to the first nestable pallet 14 on the sleeve 40 without departing from the scope of the invention.

During operation, first nestable pallet 14 of the stackable sleeve pack 10, as shown in FIG. 1, is nested with a second nestable pallet 12 of another stackable sleeve pack 10 in the second nesting configuration, as shown in FIG. 2. Thus, the first nestable pallet 14 of FIG. 1 is oriented ninety degrees from an unnestable orientation (i.e. corner feet 22 of the first nestable pallet 14 are vertically aligned with corner feet 22 of the second nestable pallet 12 and off-set corner feet of the first nestable pallet 14 are vertically aligned with off-set corner feet of the second nestable pallet 12) with respect to the second nestable pallet 12 of FIG. 2 to place the pallets 12, 14 in a nestable orientation (i.e. corner feet 22 of the first nestable pallet 14 are aligned with the receiving areas 30 of the second nestable pallet 12 and the off-set corner feet 24 of the second nestable pallet 14 are aligned with the receiving areas 32 of the first nestable pallet 14). Accordingly, the corner foot 22 of the first nestable pallet 14 is received by the receiving area 30, between the two legs 28 of the second nestable pallet 12. Similarly, the off-set corner foot 24 of the first nestable pallet 14 is received by the receiving area 32, between the two legs 26 of the second nestable pallet 12. At the same time, the central foot 46 of the first nestable pallet 14 are received by the central receiving area 47 of the second nestable pallet 12. Further, the first side foot 48 of the first nestable pallet 14 are received by the receiving area 52, between the second side foot 50, of the second nestable pallet 12. Likewise, the second side foot 50 of the first nestable pallet 14 are received by the receiving area 54, between the first side foot 48, of the second nestable pallet 12. Unlike traditional sleeve packs, the stackable sleeve pack 10 of the present disclosure advantageously inhibits the nestable pallets 12, 14 from sticking and/or binding together when stacked due to the partially exposed receiving areas 30, 32, 47, 52, 54 configured to receive feet 22, 24, 46, 48, 50.

Figure 4:
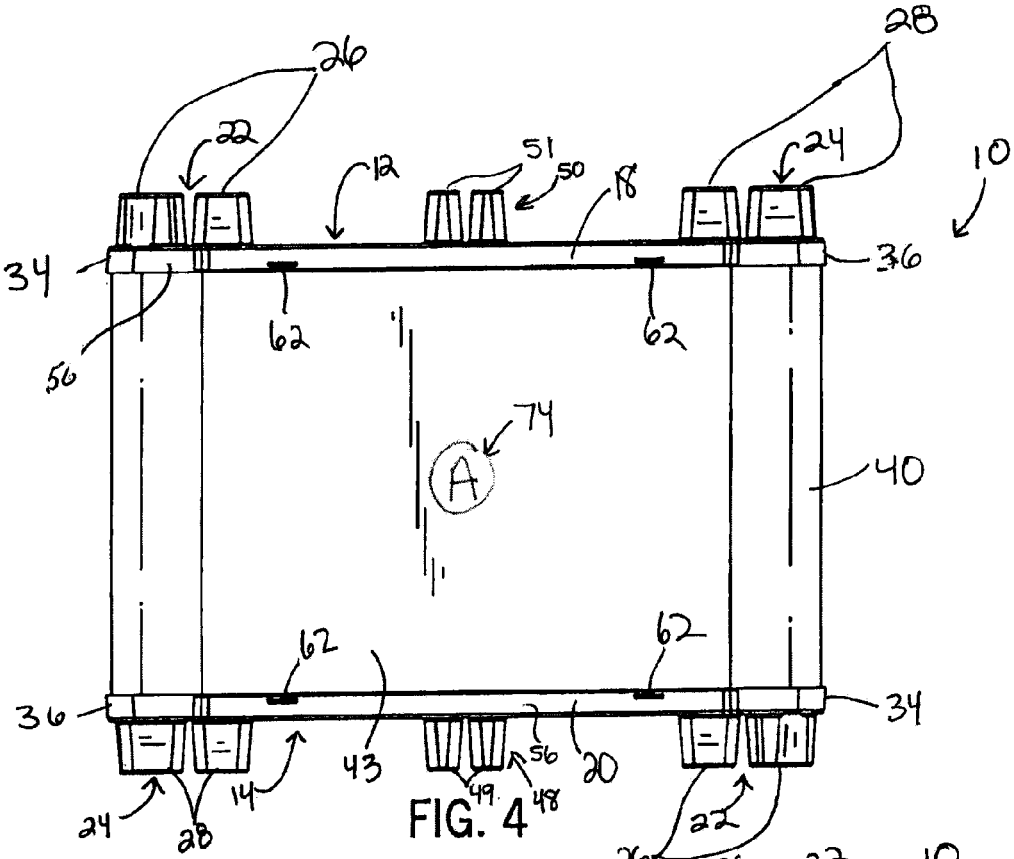
FIG. 4 is a side perspective view of the stackable sleeve pack of FIG. 1.
Figure 5:
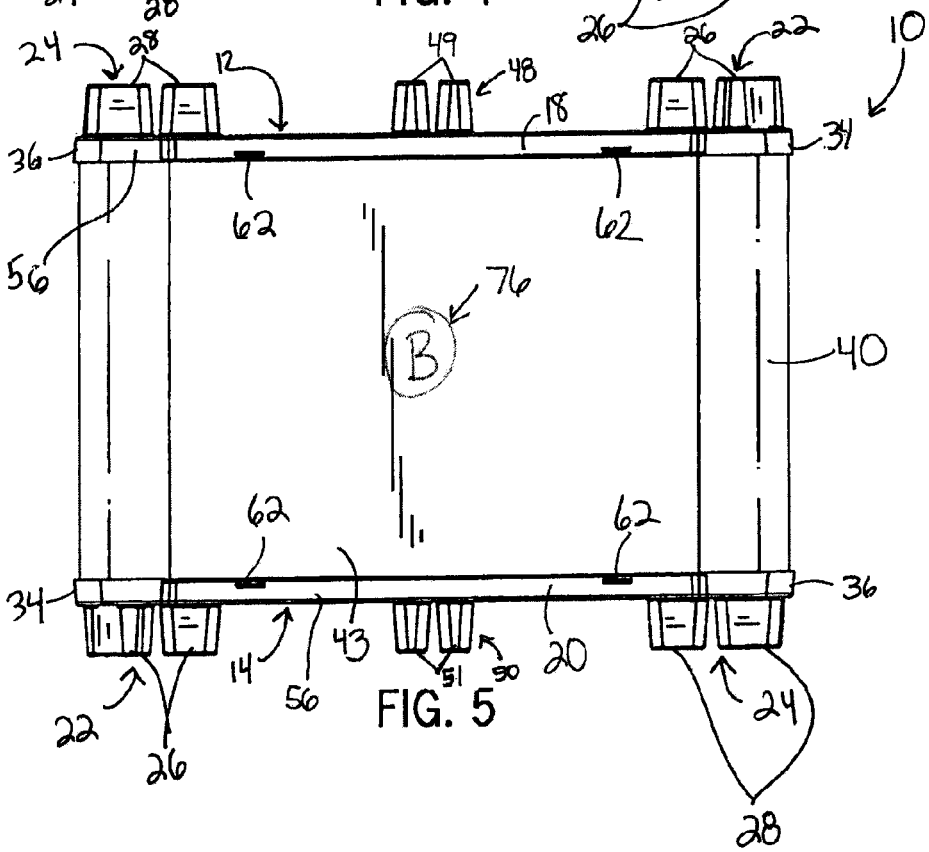
FIG. 5 is a side perspective view of the stackable sleeve pack of FIG. 4 rotated 90 degrees.

Additional stackable sleeve packs 10 can be stacked, as described above, with the stackable sleeve packs 10, for example, of FIGS. 1 and 2. To simplify stacking the stackable sleeve packs 10 with one another, a first label 74 or indicator can be placed on one of the side walls 43 of the sleeve 40, and a second label 76 or indicator can be placed on one of the adjacent side walls 43, as shown in FIGS. 4 and 5. As a result, when a fork truck operator, for example, wants to stack one stackable sleeve pack 10 with another stackable sleeve pack 10, the first label 74 on one stackable sleeve pack 10 can be aligned with the first label 74 on another stackable sleeve pack 10 to ensure the feet 22, 24, 46, 48, 50 of the first pallet of one sleeve pack 10 properly aligns with receiving areas 30, 32, 47, 52, 54 of a second pallet of another sleeve pack 10 for besting of the first and second pallets, as shown in FIG. 7. Similarly, the second label 76 on one stackable sleeve pack 10 can be aligned with the second label 76 on another stackable sleeve pack 10 to ensure the sleeve packs 10 are properly stacked and first and second pallets properly nested.

In a preferred embodiment, the indicators are different colored slidable tabs 62, wherein slidable tabs 62 on one pair of opposing sides of the pallets 12, 14 are the same color and the slidable tabs 62 on the sides of the pallet 12, 14 adjacent to the one pair of opposing sides are a different color. In use, when a fork truck operator, for example, wants to stack one stackable sleeve pack 10 with another stackable sleeve pack 10 (i.e. the first nestable pallet 14 of one sleeve pack nests with a second nestable pallet 12 of another sleeve pack in the second nesting configuration), the slidable tabs 62 of one color on one stackable sleeve pack 10 can be aligned with the slidable tabs 62 of a different color on another stackable sleeve pack 10 to ensure the feet 22, 24, 46, 48, 50 of the first pallet of one sleeve pack 10 properly aligns with receiving areas 30, 32, 47, 52, 54 of a second pallet of another sleeve pack 10 for proper stacking, as shown in FIG. 7. Advantageously, like colored tabs 62 are aligned with like colored tabs 62 to nest the nestable pallets 12, 14 in the first nesting configuration. Of course, alternative labels and/or indicators may be implemented to facilitate stacking the stackable sleeve packs 10 with one another without departing from the scope of the invention.

While there has been shown and described what are at present considered the preferred embodiments of the invention, it will be obvious to those skilled in the art that various changes and modifications can be made therein without departing from the scope of the invention defined by the appended claims.

We claim:

1. A nestable pallet comprising:

a first frame;

at least one corner foot extending away from said frame;

at least one off-set corner foot extending away from said frame, said at least one corner foot being complementary with said at least one off-set corner foot, such that the pallet is nestable with a substantially identical pallet in a first nesting configuration by inserting the at least one corner foot of the nestable pallet into a corner foot of the substantially identical pallet and in a second nesting configuration by orientating the nestable pallet relatively to a substantially identical pallet less than 180 degrees from an unnestable orientation in which said at least one corner foot of the nestable pallet is aligned with at least one corner foot of the substantially identical pallet and said at least one off-set corner foot of the nestable pallet is aligned with at least one off-set corner foot of the substantially identical pallet to a nestable orientation in which the at least one corner foot of the substantially identical pallet is aligned with a receiving area adjacent said at least one off-set corner foot of the nestable pallet and the at least one off-set corner foot of the substantially identical pallet is aligned with a receiving area adjacent said at least corner foot of the nestable pallet; and a first indicator associated with a first side of said nestable pallet and a second indicator associated with an adjacent second side of said nestable pallet, wherein alignment of said first indicator with a second indicator associated with a second side of said substantially identical pallet indicates said pallet is oriented for nesting with said substantially identical pallet in the first nesting configuration, said first indicator being distinguishable from said second indicator.

2. The nestable pallet as in claim 1, in which said first frame, and the pallet is nestable with a substantially identical pallet only upon rotating the pallet 90 degrees relative to the substantially identical pallet from the unnestable orientation to the nestable orientation.

3. The nestable pallet as in claim 1, in which said at least one corner foot includes a leg aligned with a first line extending through a center of said frame, and said at least one off-set corner foot includes two legs offset from a second line extending through a center of the frame, wherein the corner foot of the pallet is received between two legs of an off-set corner foot of the substantially identical pallet when the pallet nests with the substantially identical pallet.

4. The nestable pallet as in claim 3, in which said at least one corner foot includes two legs aligned with said first line, and said two legs offset from the second line of the substantially identical pallet are interposed between the two legs of said at least one corner foot when the pallet nests with the substantially identical pallet.

5. The nestable pallet as in claim 1, in which said at least one corner foot is proximal a corner of said frame, and said at least one off-set corner foot is proximal another corner of said frame.

6. The nestable pallet as in claim 1, in which said frame is substantially square.

7. The nestable pallet as in claim 1, including a structural sheet fixed to said first frame and forming a load support surface, said structural sheet increasing rigidity of said first frame.

8. The nestable pallet of claim 7 in which said structural sheet is fixed to said first frame over an inside surface of said first frame.

9. The nestable pallet as in claim 1, including a sleeve supported by said pallet.

10. The nestable pallet as in claim 1, including a second nestable pallet substantially identical to said first nestable pallet supported by a sleeve, wherein legs of said second nestable pallet extending from a frame of said second nestable pallet away from said first frame.

11. The nestable pallet as in claim 1, in which said first frame is molded to have a material thickness of less than about 0.200 inches and includes a structural sheet bonded to said first frame and forming a load support surface, said structural sheet increasing rigidity of said first frame.

12. A nestable pallet comprising:

a first frame having an inside surface and molded to have a material thickness of less than about 0.200 inches;

at least one corner foot extending away from said frame;

at least one off-set corner foot extending away from said frame, said at least one corner foot being complementary with said at least one off-set corner foot, such that the pallet is nestable with a substantially identical pallet in first nesting configuration by inserting the at least one corner foot of the nestable pallet into a corner foot of the substantially identical pallet and in a second nesting configuration by orientating the nestable pallet relative to a substantially identical pallet less than 180 degrees from an unnestable orientation in which said at least one corner foot of the nestable pallet is aligned with at least one corner foot of the substantially identical pallet and said at least one off-set corner foot of the nestable pallet is aligned with at least one off-set corner foot of the substantially identical pallet to a nestable orientation in which the at least one corner foot of the substantially identical pallet is aligned with a receiving area adjacent said at least one off-set corner foot of the nestable pallet and the at least one off-set corner foot of the substantially identical pallet is aligned with a receiving area adjacent said at least corner foot of the nestable pallet;

a first indicator associated with a first side of said nestable pallet and a second indicator associated with an adjacent second side of said nestable pallet, wherein alignment of said first indicator with a second indicator associated with a second side of said substantially identical pallet indicates said pallet is oriented for nesting with said substantially identical pallet in the first nesting configuration, said first indicator being distinguishable from said second indicator and a structural sheet fixed to said first frame and forming a load support surface over said inside surface, said structural sheet increasing rigidity of said first frame.

13. The nestable pallet as in claim 12, in which said first frame, and the pallet is nestable with a substantially identical pallet only upon rotating the pallet 90 degrees relative to the substantially identical pallet from the unnestable orientation to the nestable orientation.

14. The nestable pallet as in claim 12, in which said at least one corner foot includes a leg aligned with a first line extending through a center of said frame, and said at least one off-set corner foot includes two legs offset from a second line extending through a center of the frame, wherein the corner foot of the pallet is received between two legs of an off-set corner foot of the substantially identical pallet when the pallet nests with the substantially identical pallet.

15. The nestable pallet as in claim 14, in which said at least one corner foot includes two legs aligned with said first line, and said two legs offset from the second line of the substantially identical pallet are interposed between the two legs of said at least one corner foot when the pallet nests with the substantially identical pallet.

16. The nestable pallet as in claim 12, in which said at least one corner foot is proximal a corner of said frame, and said at least one off-set corner foot is proximal another corner of said frame.

17. The nestable pallet as in claim 12, in which said frame is substantially square.

18. The nestable pallet as in claim 12, including a sleeve supported by said frame.

19. The nestable pallet as in claim 18, including a second pallet substantially identical to said nestable pallet supported by said sleeve.

* * * * *